US007275373B2

(12) United States Patent
Luetge et al.

(10) Patent No.: US 7,275,373 B2
(45) Date of Patent: Oct. 2, 2007

(54) HIGH PRESSURE DEVICE AND METHOD FOR CLEAN ROOM APPLICATIONS

(75) Inventors: Christoph Luetge, Unna (DE); Hans-Ottomar Kurtz, Dortmund (DE)

(73) Assignee: Uhde High Pressure Technologies GmbH, Hagen (DE)

( * ) Notice: Subject to any disclaimer, the term of this patent is extended or adjusted under 35 U.S.C. 154(b) by 0 days.

(21) Appl. No.: 10/536,341

(22) PCT Filed: Nov. 13, 2003

(86) PCT No.: PCT/DE03/03755

§ 371 (c)(1),
(2), (4) Date: Sep. 21, 2005

(87) PCT Pub. No.: WO2004/048782

PCT Pub. Date: Jun. 10, 2004

(65) Prior Publication Data

US 2006/0130477 A1 Jun. 22, 2006

(30) Foreign Application Priority Data

Nov. 26, 2002 (DE) ..... 102 55 230

(51) Int. Cl.
*F15B 3/00* (2006.01)
*F15B 11/72* (2006.01)
*F15B 11/32* (2006.01)

(52) U.S. Cl. ..... 60/533; 92/80

(58) Field of Classification Search ..... 60/533, 60/560, 563, 593, 565; 92/80, 82
See application file for complete search history.

(56) References Cited

U.S. PATENT DOCUMENTS

| | | | | |
|---|---|---|---|---|
| 3,721,091 | A | 3/1973 | Tomoinaga et al. | |
| 4,208,879 | A * | 6/1980 | Segawa | 60/563 |
| 5,207,267 | A * | 5/1993 | Iwamoto et al. | 164/457 |
| 5,377,488 | A | 1/1995 | Malina | |
| 6,067,728 | A | 5/2000 | Farmer et al. | |

(Continued)

FOREIGN PATENT DOCUMENTS

| | | |
|---|---|---|
| CA | 2001707 | 4/1991 |

(Continued)

OTHER PUBLICATIONS

Japan Forciert Wasserhydraulic, Mar. 1993.

(Continued)

*Primary Examiner*—Igor Kershteyn
(74) *Attorney, Agent, or Firm*—Marshall & Melhorn, LLC

(57) ABSTRACT

A device uses hydraulic actuation for the closure of a vessel by a rotation-symmetric reciprocating piston mechanism of an extremely compact type, which includes a reciprocating hydraulic piston and an intensifier piston, which are in each case moved in cylinders. The hydraulic piston is driven water-hydraulically and the intensifier piston pneumatically, these two forming a direct axial functional unit via a fluid, which is located in a chamber between the lower face of the hydraulic cylinder and the upper face of the intensifier piston. The upper face of the hydraulic piston forms at least partially the plug-type closure of the vessel or is rigidly connected to a closure element of the vessel.

17 Claims, 4 Drawing Sheets

U.S. PATENT DOCUMENTS 6,705,082 B2 3/2004 Ju
6,895,749 B2 * 5/2005 Tohru ..... 60/563

FOREIGN PATENT DOCUMENTS

DE 100 26 616 A1 4/1991
DE 4 022 159 A 5/1991
DE 199 46 678 A1 4/2001
JP 55 126103 9/1980
JP 92 80202 10/1997
WO WO 01/69088 A1 9/2001

OTHER PUBLICATIONS

Morkowski, Dipl.Ing. Chem. J.S.; "Verminderung von Partikelemissionen einer hydraulischen Presse", Swiss Contamination Control 5, No. 5, 1992, pp. 8-9.
Fritz, Dr.-Ing. Erhard; Einsatzmoeglichkeit von kolbenstangenlosen Pneumatikzylindern in Reinraaaaaeumen, vol. 2, Mar. 1998, pp. 283-293.

* cited by examiner

HIGH PRESSURE DEVICE AND METHOD FOR CLEAN ROOM APPLICATIONS

BACKGROUND OF THE INVENTION

The invention relates to a device for the closure of a vessel and/or forming and pressing semi-finished products by means of a rotation-symmetric reciprocating piston mechanism of extremely compact design, which includes a hydraulic piston and an intensifier piston, each of which run in cylinders. The hydraulic piston is driven using water, the intensifier piston pneumatically, the two forming a direct axial functional unit via a fluid located in a space between the lower face of the hydraulic cylinder and the upper face of the intensifier piston. The upper face of the hydraulic piston forms at least partially the closure part of the vessel or it is rigidly connected to a closure element for the vessel, or the upper side of the hydraulic piston forms the tools or is rigidly connected to said tools.

The spectre of products developed by the semiconductor manufacturing, opto-electronic and other industries is constantly expanding and the said products permit to realise the central functions with the aid or on the basis of micro or nano-structures. The said structures also react extremely sensitive to minor impurities during the production phase. Hence, ever more stringent requirements are specified for the admissible emission rates of components used in the said ambience. The cleaning steps required for nano-structured surfaces cannot be carried out by conventional cleaning agents or they are hardly feasible. For some time supercritical fluids have been used on a large scale as they enhance the wetting effects and cleaning results. These operations necessitate process pressures which range from 150 to more than 300 bars and which consequently require special equipment. So far high-pressure equipment with adequate mechanical properties was not directly suitable for clean room operations or it was even unsuitable for such applications. This invention describes a high-pressure unit of a very compact design which is suited for clean-room applications at high pressure levels and which only produces minor emissions when alternating load cycles take place at high pressure level.

Reciprocating piston mechanisms for pressures of >150 bar are in broad and diverse technical and commercial use and have been adequately described in patent-specific and general technical literature.

Reciprocating piston mechanisms which include, inter alia, hydraulic pistons and intensifier pistons, with the upper face of the intensifier piston acting axially on an operating fluid, which is enclosed in the cylinder chamber below the lower face of the hydraulic piston and causes the working stroke or maximum pressure on the hydraulic piston, are also known from the relevant literature.

Specifications DE 100 26 616 A1 and WO 01/69088 A1 describe the above-mentioned reciprocating piston mechanisms in which the operating fluid of the hydraulic piston and that of the pressure intensifier is identical. JP 55126103 discloses such a reciprocating piston mechanism, which is equipped with an additional vessel in which displaced hydraulic fluid is temporarily stored. WO 01/69088 A1 also describes a return function of the hydraulic piston, the function being executed in such a way that the plunger of the hydraulic piston travels in a spring, which is clamped in the course of the piston stroke between the cylinder head and the bottom of the piston. The spring relaxes and returns the hydraulic piston to its initial position when the action of force on the piston ceases.

Also known from and adequately described in the relevant literature are reciprocating piston mechanisms which include for the hydraulic piston an operating fluid different to the operating fluid for the intensifier piston. The hydro-pneumatic devices described in Specifications JP 09280202 and DE 199 46 678 A1 may be mentioned here as examples of such combined mechanisms.

Liquids and gases are used as the operating fluids, mainly water being used for pressures of up to around 160 bar, and hydraulic fluids above 160 bar. Inert gases and air are the most commonly used gaseous operating fluids. Hydraulic fluid exhibits important beneficial characteristics in terms, inter alia, of lubrication of sliding surfaces, low compressibility and high temperature stability.

Detrimental effects which cannot be completely eliminated from piston-based devices include, inter alia, material erosion and operating fluid leakage. Friction- and pressure-induced material erosion, such as abrasion, evaporation and liquefaction, for example, occur to a limited extent even on the parent material itself and, in particular, in and on the sealing system. Material erosion in reciprocating piston mechanisms is a function essentially of the surface quality of the sliding surfaces and the manufacturing tolerances of the components, of the sealing material and the radial contact pressure of the sealing member, and also of temperature.

Leakage of the operating fluid, certain quantities of which are entrained at every piston stroke, is functionally dependent on, inter alia, quality of surfaces, viscosity, hydrostatic pressure in the cylinder chamber and also on the sealing system and sealing member design and the radial contact pressure of the sealing members and sealing system.

High working pressures necessitate adequate lubrication of the surfaces facing each other and running against one another, resulting in corresponding leakage quantities. This effect can be minimized by means of suitable sealing systems and a high-quality surface treatment. The potentials for increasing contact pressure in order to suppress leakage are however restricted by the fact that the degradation and erosion of the sealing material increases as pressure rises, with the consequences of emissions and, subsequently, greater leakage quantities. In addition, the limits of mechanical load-bearing capacity and economic operation are reached.

Impurities resulting from material erosion and leakage from the above-mentioned sources are of extreme disadvantage in the production zone, particularly in the case of cleanroom processes. Clean-room classes are defined, for example, in DIN 2083 and Federal Standard 209D. Emissions of any type whatsoever have a direct influence on the quality of the products of these processes and a high level of equipment and organizational input is applied to minimize such emissions, inevitably with high associated costs. Of particular seriousness and disadvantage is contamination with oil mists, since oil-containing emissions are in many cases chemically active and can be removed again only using solvent-containing agents which, for their part, are not desirable in cleanrooms and can, indeed, be extremely disadvantageous there.

It is known that fluid-hydraulic reciprocating piston mechanisms used in cleanrooms are somewhat problematic and have to be rendered suitable for cleanroom applications by means of appropriate exhausting systems (SWISS Contamination Control 5 (1992) No. 5, p. 8 ff.). Oil depositions occurred on the semi-finished product when a pressing die was used for the production of CD blanks, for example. Investigations revealed that the hydraulic fluid was the source of this impurities. The necessary suitability for cleanroom use was restored by fitting sealed sleeves to the die's connecting rods and by means of exhausting of the press housing and of the air from the sleeves.

A further technical article discloses a pneumatic cylinder with no piston-rod (Dr.-Ing. E. Fritz; Paper for the 1st Int. Forum Fluidtechnisches Kolloquium, Volume 2, pp. 283 ff.). Suitability for cleanroom service was achieved by generating a partial vacuum in the space between the covering strip and the sealing strip. Vacuum connections were fitted to the cylinder tube for this purpose, and the emissions were routed away.

A disadvantage of the above-mentioned reciprocating piston mechanisms incorporating an exhausting system is the fact that additional systems are necessary for the assurance of minimum particle concentrations and that these systems must be installed and continuously operated.

Spatial separation is implemented in the case of more complex production systems, in which components with cleanroom capability are used simultaneously with less suitable components. The equipment not suitable for cleanroom service is accommodated in so-called "maintenance zones", while the cleanroom-capable equipment is housed in so-called "white rooms". Such solutions necessitate complex and expensive fluid-lock systems and organizational precautions in order to ensure the exclusion of impurities from the "maintenance zone".

U.S. Pat. No. 6,067,728 disclosed a device and a process for the drying of wafers using supercritical $CO_2$, a pneumatico-mechanical closure device being incorporated. The closure of the vessel plug is accomplished by means of a pneumatic piston and lever device, pre-pressurization being achieved by means of this arrangement. The plug is locked in place by means of clips. After pneumatico-mechanical closure of the process room, one or more static clips are positioned symmetrically on the edge of the cover. These closure clips are pushed mechanically over the edge of the vessel leakage and the vessel base and provide the tightness of the vessel during the process, as internal pressure rises.

A disadvantage of the above-mentioned invention are the many moving parts, which may be regarded as critical in terms of emissions, and which severely limit the number of reciprocating strokes and/or number of possible process cycles per unit of time, as a result of the necessary movements. In addition, the many operations required also necessitate a complex control device.

SUMMARY OF THE INVENTION

The objective of the invention is to avoid additional exhaust and protective systems and/or specific partition of the available space by means of technical solutions implemented on the reciprocating piston itself. In addition, types which fulfill the necessities of safe and dependable operation with the lowest possible number of movements and lowest possible number of moving parts are to be achieved.

The present invention provides for a solution to this problem in accordance with the main claim by means of a device for closure of a process vessel using a reciprocating cylinder, characterized in that the reciprocating cylinder consists of not less than one water-hydraulically driven piston which, via a fluid, forms a direct functional unit in axial direction with a pneumatically driven intensifier piston, the upper face of the hydraulic piston taking the form of an integral component of a vessel and constituting the vessel's closure element.

In a further embodiment of the invention, at least a part of the sliding surfaces exhibits a surface structure support ratio of >60%.

In another embodiment of the invention, at least a part of the sliding surfaces is hardened.

In a further process embodiment, a fluid other than water is used in the cylinder chamber, this fluid preferably being a readily volatile fluid, or a gas being used as the operating fluid. It is advantageous to operate the hydro-pneumatic piston using compressed air or another gas or mixture of gases.

In a further advantageous variant of the process arrangement, resetting of the hydraulic piston by the fluid enclosed in the cylinder chamber directly accomplishes resetting of the intensifier piston, since the fluid acts on the upper face of the intensifier piston so that it returns to its starting position.

A developed variant of the process arrangement includes synchronization of the reciprocating and closure unit with the process cycle taking place in the vessel.

In a further advantageous embodiment of the process, a pressure of >180 bar is reached at regular intervals on the upper face of the hydraulic piston and/or in the vessel, the pressure in said face regularly being equal to or greater than the pressure in the vessel.

The invention also includes an application of the device for processes in which at least one supercritical gas is used in the vessel.

The device and process in accordance with the invention can therefore be advantageously used for processes which take place directly or indirectly in clean-room and/or in similar laboratory or working facilities.

The invention also includes an application of the device and/or process for manufacturing processes directly or indirectly associated with at least one application, production method or process in the semiconductor and/or wafer production industry, the optics industry, the pharmaceuticals industry and/or medical and medicinal products industries.

In a further advantageous embodiment of the device, the upper face of the hydraulic piston takes the form of a pressing die or is rigidly connected to a pressing die, the latter essentially moving also axially relative to the hydraulic piston. A pressing process using the above-mentioned pressing die, which would be utilized for pressing operations, such as forming, gluing/adhesive bonding or for input of materials under clean-room conditions, is thus covered by the invention.

BRIEF DESCRIPTION OF THE DRAWINGS

FIG. 1: Reciprocating piston mechanism

FIG. 2: Reciprocating piston mechanism and valves in the starting position of the reciprocating operation ("vessel open")

FIG. 3: Reciprocating piston mechanism and valves at the end of the pre-pressurising phase and pressure intensifier in starting position ("vessel closed")

FIG. 4: Reciprocating piston mechanism and valves during the high-load phase, pressure intensifier in end position ("vessel locked")

DETAILED DESCRIPTION OF THE INVENTION

Figure 1:
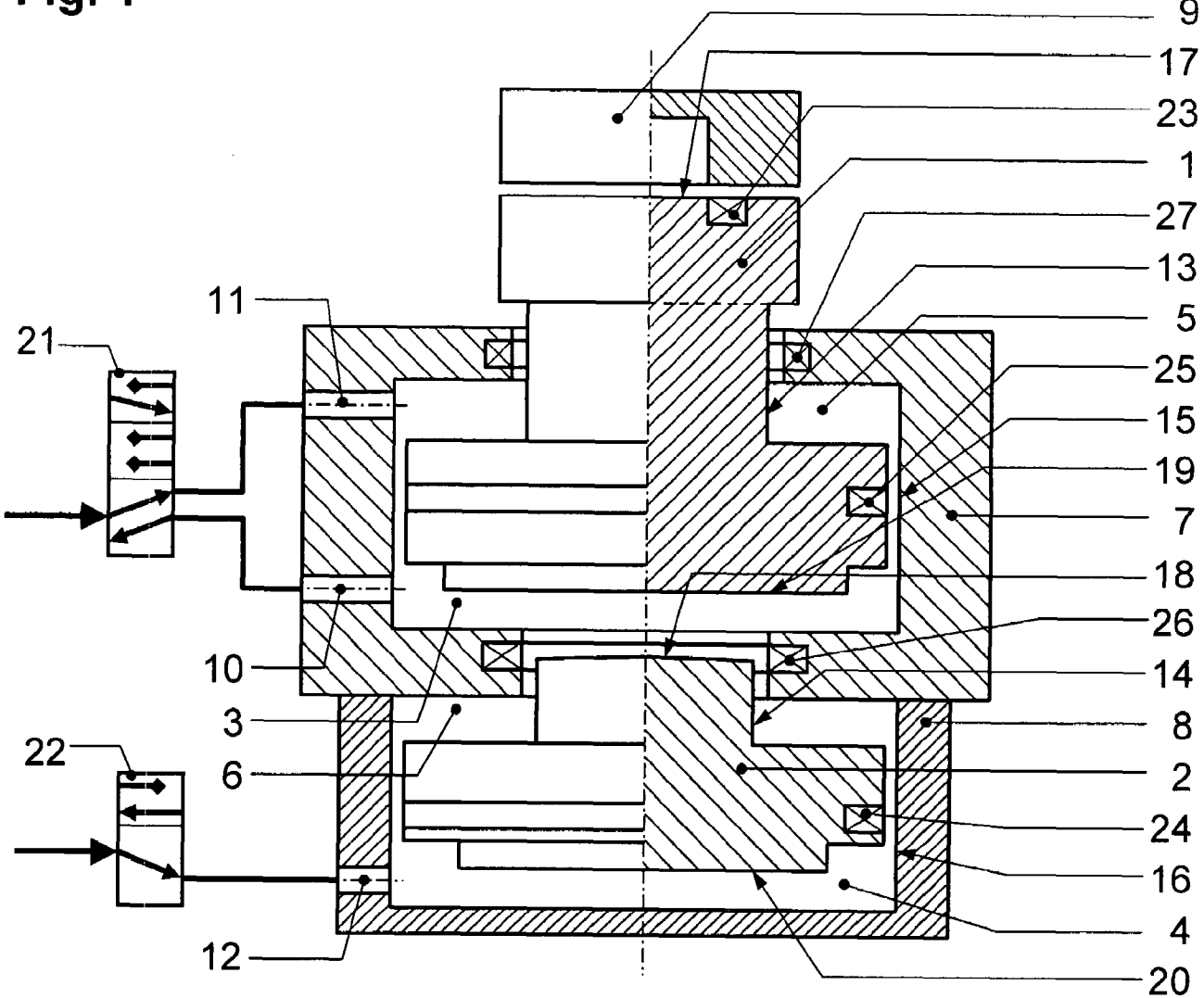
FIGS. 1 to 4 show a longitudinal sectional view of the device.

The present invention is described below in more detail using further explanatory notes, examples and FIGS. 1 to 4. FIG. 1 shows the hydropneumatic reciprocating piston and closure unit in accordance with the invention, in which a water-hydraulic hydraulic piston (1) forms axially a direct functional unit with a pneumatic intensifier piston (2), via a fluid, which is located in cylinder chamber (3). The upper end face (18) of the pressure intensifier acts on the above-mentioned fluid and is arranged parallel to the bottom surface (19) of the hydraulic cylinder. The upper end of hydraulic piston 1 additionally forms the closure of pressure vessel (9) and is in the present version the bottom plate of the vessel (9). Sliding surfaces (13-16) of the reciprocating piston and closure unit in accordance with the invention are designed in such a way that they have a high support ratio and/or high hardness.

Figure 2:
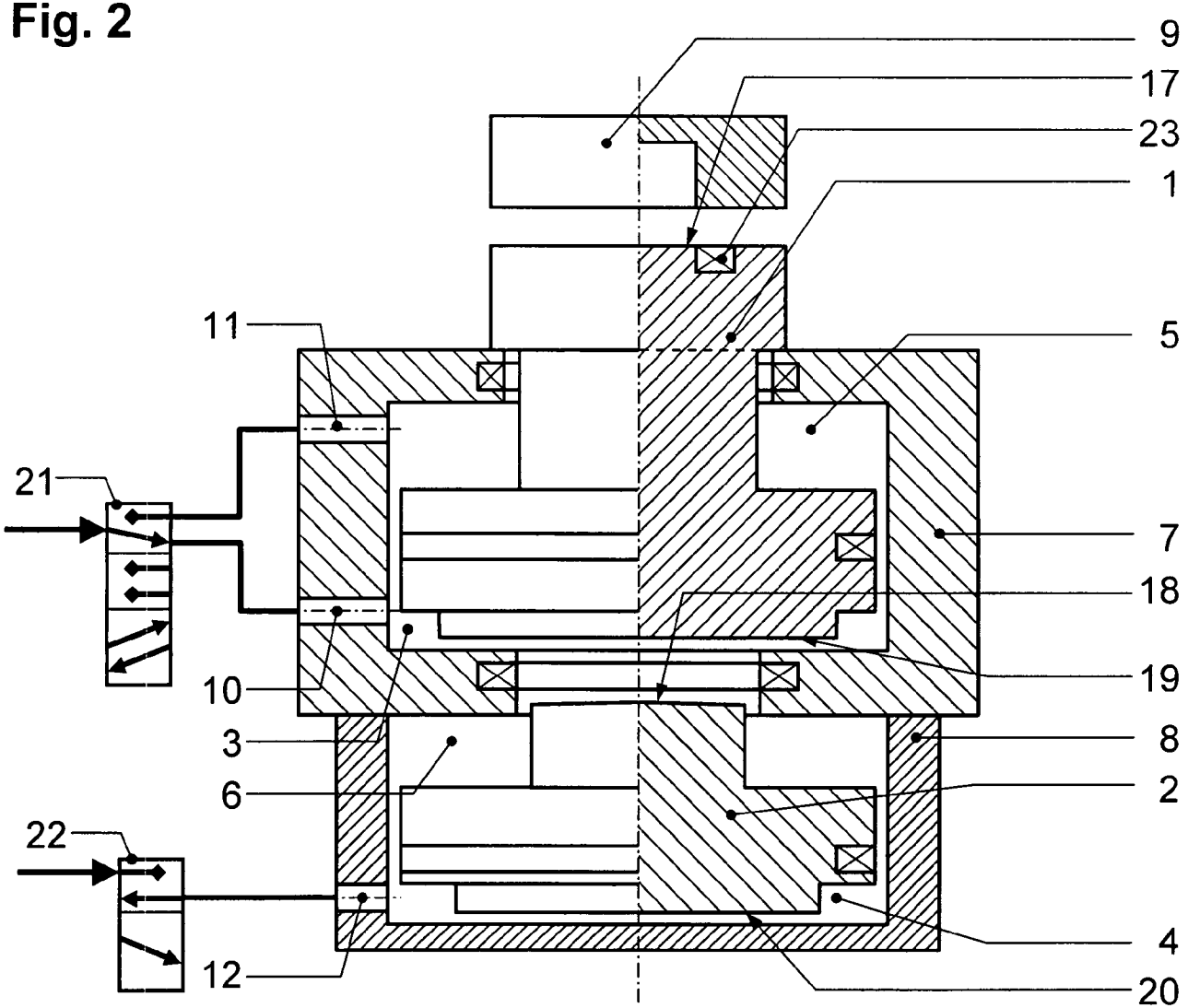
Figure 3:
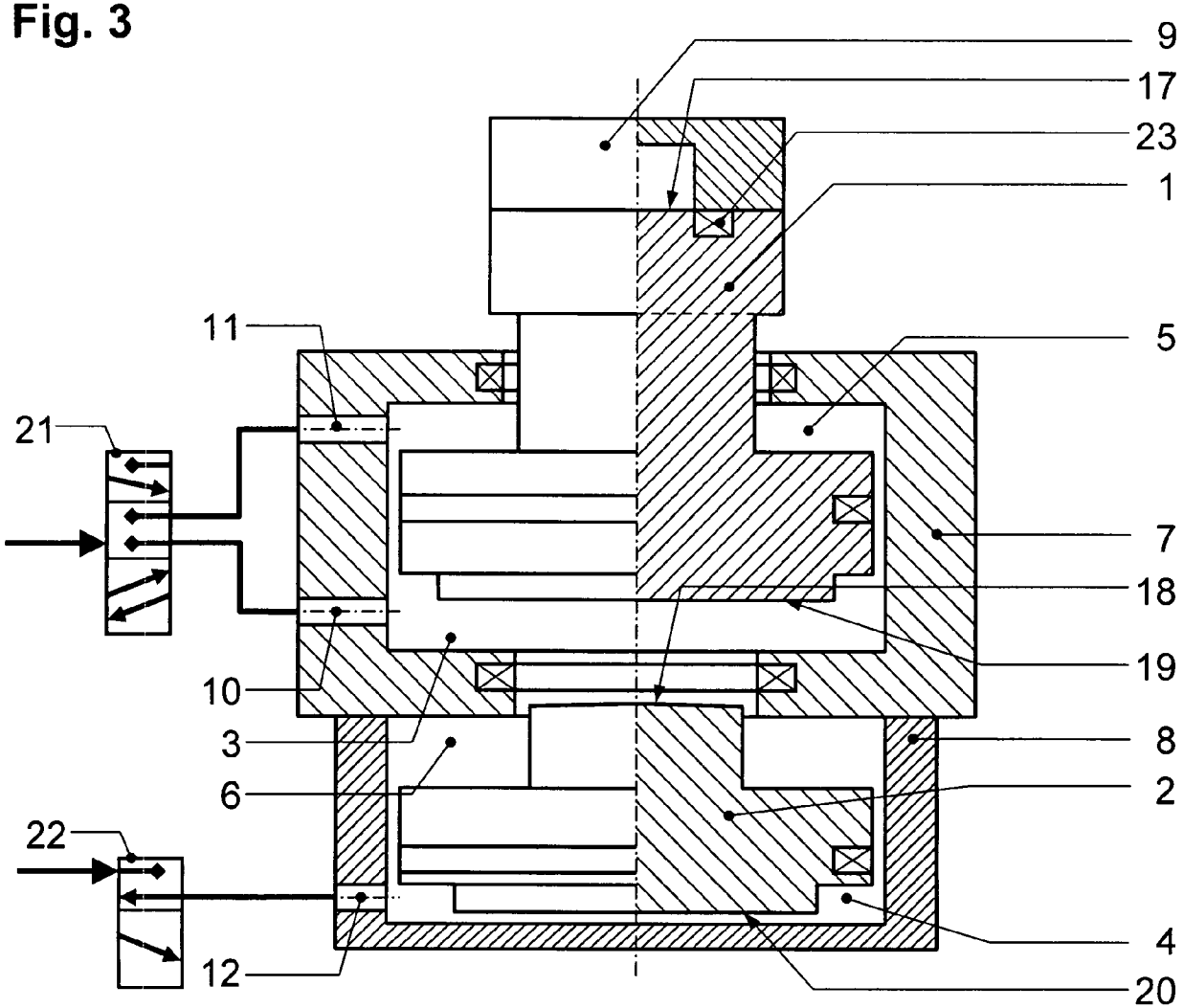
Figure 4:
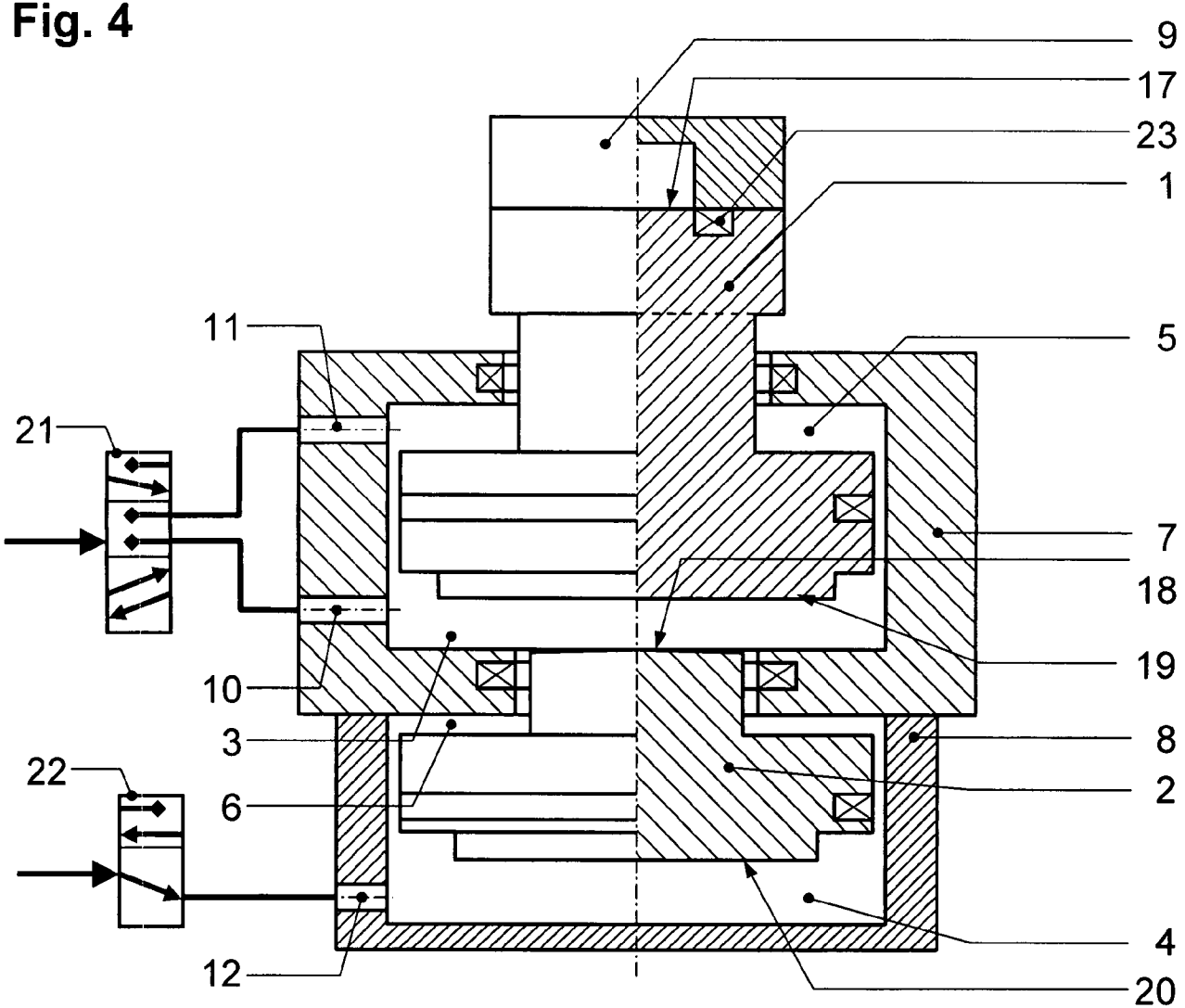

FIGS. 2 to 4 show in schematic form the device and the process as they have already been implemented in a test facility on an industrial 1:1 scale. This test facility has been operated continuously at full load for a period of ten weeks. The pilot pressure in cylinder chamber (3) was achieved from a large water-piping system with no additional pressure boosting and was around 6 bar. $N_2$ from a battery of pressure cylinders was used as the pneumatic operating fluid for cylinder chamber (4), the pressure of 25 bar being achieved by means of corresponding pressure reduction. This test apparatus and this process achieved within a period of ten consecutive weeks approximately 100000 load cycles at a working pressure of 1 to approx. 260 bar on the upper face (17) of hydraulic piston (1). In the test apparatus, the upper face of hydraulic piston 1 was moved up against a yoke and held there for approx. 3 seconds in every cycle.

With respect to preparation of the material sliding surfaces, it became apparent that the sliding surfaces need to have a support ratio of >60% in order to avoid galling of the sliding surfaces and that hardening of these surfaces is an advantage. Austenitic materials were used; this device is not restricted to this group of materials, however.

The methods for achievement of high support ratios are adequately described in the relevant literature. Applicable processes include, for example, honing, lapping and tumbling. Hardening of the surfaces pretreated in this way can be achieved by means of plasma-nitriding, kolsterizing or hard chromium plating, it is also state-of-the-art and is commercially available from specialized companies.

This also covers a process for operation of the device in accordance with the invention, in which a hydraulic piston 1 is moved to the load position by means of hydrostatic water pressure (FIG. 3). Valve (21) is of a type that permits to close bores (10 and 11). Positioning of intensifier valve (22) causes pressure to be applied to the lower face (20) of the intensifier piston, thus moving this piston. The ultimate pressure in the closed cylinder chamber (3) rises in accordance with the ratio of the surfaces of lower face (20) to upper face (18), and the necessary contact pressure of the upper face (18) on to vessel (9) is generated on sealing member (23) via hydraulic piston (1).

After completion of the load cycle, intensifier valve (22) is opened and cylinder chamber (4) depressurized, the operating fluid of pressure intensifier (2) being released into the atmosphere. Hydraulic valve (21) is then set in such a way that cylinder chamber (5) is water-hydraulically pressurized, with the result that hydraulic piston (1) moves to its starting position synchronously with intensifier piston (2).

The cycle starts again from the "vessel open" position (FIG. 2), with positioning of hydraulic valve (21) causing operating fluid to be fed via bore (10) into cylinder chamber (3).

The function of pressure intensifier (2) depends on the return motion of hydraulic piston (1), which constitutes a particularly advantage with reference to the current state of the art. This link eliminates the need for separate resetting of intensifier piston (2) and for precise control of the valve cycles. There is also advantage in that the valve position is largely uncoupled at the start of the load cycle. For initial pressurization of cylinder chamber (3), intensifier valve (22) can remain in the position which it attained at the end of the load cycle ("locked vessel" position; see FIG. 4). Compared to known devices, synchronization of piston resetting, uncoupled valve positions at the start of the load cycle and extremely short stroke lengths mean that the device does not require a sophisticated control unit and is particularly suitable for rapid load changes and high pressures.

Compared to known devices, mechanical damage is largely prevented by the fact that indirect transmission of force is achieved from the intensifier piston to the hydraulic piston via the fluid bridge in cylinder chamber (3). This is ensured by the fact that in the "Vessel closed" end position, cylinder chambers (5 and 6) are not completely emptied and that the surfaces of the pistons therefore never come into direct axial contact with the cylinder walls in the direction of the stroke. This also applies to the upper face of the intensifier piston relative to the lower face of the hydraulic piston.

A particular advantage compared to known reciprocating piston mechanisms is the gentle operation of the hydraulically operated piston (1), which results in only minor loads being exerted on sealing members (25 and 27). In the end position of hydraulic piston (1) with onset of ultimate force via pressure intensifier (2), there is no further motion relative to one another between the sealing surface and piston walls (13 and 15). Potential emissions from sealing members (24 and 26) are retained in cylinder chambers (3, 4 and 6) and expelled via bores (10, 12 and 24) during the normal working cycle. No additional partial vacuum is necessary, and a significant advantage is therefore achieved compared to the current state of the art.

KEY OF DIAGRAMS

1 Hydraulic piston
2 Intensifier piston
3 Intermediate space
4 Cylinder chamber
5 Cylinder chamber
6 Cylinder chamber
7 Hydraulic cylinder
8 Intensifier cylinder
9 Pressure vessel
10 Bore
11 Bore
12 Bore
13 Sliding surface
14 Sliding surface
15 Sliding surface
16 Sliding surface
17 Upper face of the hydraulic piston
18 Upper face of the intensifier piston
19 Lower face of the hydraulic piston
20 Lower face of the intensifier piston
21 Hydraulic valve
22 Intensifier valve
23 Sealing member
24 Sealing member
25 Sealing member
26 Sealing member
27 Sealing member

The invention claimed is:

1. A reciprocating piston device for the closure of a vessel and consisting of at least one base element and one closure element, said system encompassing at least one movable piston (1) each of the at least one movable pistons with one hydraulic cylinder (7), and at least one movable intensifier piston (2) each of the at least one intensifier pistons with one intensifier cylinder (8), all of which are rotationally symmetrical, each hydraulic piston (1) and its hydraulic cylinder (7) and each intensifier piston (2) and its intensifier cylinder (8) being arranged along an axis of rotation, each hydraulic piston (1) featuring on the piston end located in the hydraulic cylinder (7) at least one circumferential reinforcement running radially on its outer surface, with an internal space between the hydraulic cylinder (7) and the hydraulic piston (1) divided into not less than two subsidiary spaces (3 and 5) not less than one bore (10 and 11) in each hydraulic cylinder (7) leading to each of these subsidiary spaces, the cylinder (1) being driven water-hydraulically and the intensifier piston (2) pneumatically, wherein the hydraulic piston (1) and intensifier piston (2) are incorporated into a direct axial function in relation to the axis of rotation, via the fluid located in space (3) between a lower face (19) of each piston (1) and an upper face (18) of each intensifier piston (2), the upper face of hydraulic piston (1) forming at least part of the closure of a vessel (9) or being rigidly connected to the closure part of the vessel (9), and the closure part essentially moves along the axis of rotation in relation to the hydraulic piston (2), and the vessel (9) is arranged opposite the upper face of the hydraulic piston (1), and at least one sliding surfaces (13 to 16) located on the internal surfaces of the cylinders and on the piston surfaces in the zones in which the cylinder and piston surfaces are located opposed to one another and in contact and move relative to one another parallel to the axis of rotation, shows a support ratio of >60%, said ratio representing the proportion of "peaks" to the "valleys" of the surface structure, and the reciprocating piston system is open with regard to the feed and discharge of the operating fluid.

2. A device according to claim 1, wherein at least one of the sliding surfaces located on the internal surfaces of the cylinder and the piston surfaces in the zones in which the cylinder and piston surfaces are located opposed to one another and are in contact and are moved relative to one another parallel to the axis of rotation is hardened.

3. A process for operation of the device according to claim 1, wherein the position of a hydraulic valve (21), which controls the feed and discharge of cylinder chambers (3 and 5) of hydraulic cylinder (7), causes feeding of fluid to the lower face (19) of hydraulic piston (1) by feeding, via not less than one delivery line and bores (10), of fluid into space (3) between the upper face (18) of the intensifier piston (2) and the lower face (19) of the hydraulic piston (1), and thus moves the hydraulic piston from the "vessel open" starting position to the "vessel closed" pre-pressurizing position and closing vessel (9), the hydraulic valve (21) then moving in such a way that all routes to borings (10 and 11) assigned to the hydraulic cylinder (7) of hydraulic piston (1) are closed and the subsequent positioning of an intensifier valve (22), which controls the feed and discharge of the cylinder chambers (4 and 6) of the intensifier piston, causing fluid to be applied to lower face (20) of the intensifier piston (2) by the feeding, via not less than one delivery line and bores (12) in the cylinder wall, of fluid into the cylinder chamber (4) below the lower face (20) of the intensifier piston (2) and the intensifier piston (2) therefore moving to the "vessel locked" end position and the position being maintained for any period of time required, the intensifier valve (22) then being opened and the fluid in cylinder chamber (4) below lower face (20) of intensifier piston (2) being depressurized and subsequently the hydraulic valve (21) being positioned in such a way that via at least one delivery line and bore (11) fluid is fed into the upper space (5) in hydraulic cylinder (7) of hydraulic piston (1) and the pressure acting on the essentially annular and essentially parallel surface of the circumferential piston reinforcement located opposite the lower face (19) of hydraulic cylinder (1) in such a way that hydraulic piston (1) moves to its "vessel open" starting position, the fluid, which is enclosed in the space underneath the hydraulic piston (1), thereby acting on the upper face (18) of the intensifier piston (2) and also moving this, into its starting position.

4. A device according to claim 1, wherein a readily volatile fluid from the group formed by ethanol, methanol, water, isopropanol and similar substances or mixtures, is used as the fluid in the spaces formed by the hydraulic cylinder (7) and hydraulic piston (1).

5. A device in according to claim 1, wherein a readily volatile fluid from the group formed by ethanol, methanol, water, isopropanol and similar substances or mixtures thereof, is used as the fluid in spaces (4 and 6) formed by the intensifier cylinder (8) and intensifier piston (2).

6. A device according to claim 1, wherein a working pressure of >180 bar is regularly reached on the upper face (17) of hydraulic piston (1).

7. A device according to claim 1, wherein a pressure of >180 bar is regularly reached in vessel (9).

8. The device according to claim 1, wherein a gas consisting essentially of $CO_2$, oxygen, nitrogen, a noble gas or mixtures thereof is used as gas in the spaces formed by the hydraulic cylinder and the hydraulic piston.

9. The device according to claim 1, wherein a gas consisting essentially of $CO_2$, oxygen, nitrogen, a noble gas or mixtures thereof is used as the gas in the spaces formed by the intensifier cylinder and the intensifier piston.

10. A reciprocating piston device for pressing or forming of at least one semi-finished product, consisting of not less than one hydraulic piston (1) each with a hydraulic cylinder (7), and not less than one moving intensifier piston (2) each with an intensifier cylinder (8), all rotationally symmetrical the hydraulic piston (1) and its hydraulic cylinder (7) and the intensifier piston (2) and its intensifier cylinder (8) each being arranged along an axis of rotation, and the hydraulic piston end located in the hydraulic cylinder having not less than one circumferential reinforcement running radially on the external surface, such that the internal space between the hydraulic cylinder (7) and the hydraulic piston (1) is divided into not less than two subsidiary chambers (3 and 5), and at least one bore (10 and 11) in the hydraulic cylinder (7) leading to each of these subsidiary chambers (3 and 5), the hydraulic piston (1) being actuated water-hydraulically and the intensifier piston (2) pneumatically, wherein the hydraulic piston (1) and the intensifier piston (2) form a direct axial functional unit with one another relative to the axis of rotation, with the aid of a fluid which is located in a space (3) between a lower face (19) of the hydraulic cylinder (1) and an upper face (18) of the intensifier piston (2), the upper face of hydraulic piston (1) at least partially forming the pressing or forming tool or being rigidly connected to a pressing or forming tool and this pressing or forming tool essentially moving along the axis of rotation relative to the hydraulic piston (1) and the semi-finished product being located opposite an upper face (17) of hydraulic piston (1), at least one of the sliding surfaces (13 to 16) located on the internal surfaces of the cylinders and on the piston surfaces in the zones in which the cylinder and piston surfaces are located opposed to one another and in contact and move relative to one another parallel to the axis of rotation, shows a support ratio of >60%, said ratio representing the proportion of elevations ("peaks") to the depressions ("valleys") of the surface structure.

11. The device according to claim 10, wherein at least one of the sliding surfaces located on the internal cylinder surfaces and on the piston surfaces in the zones in which the cylinder and piston surfaces are located opposite one another and are in contact and moved parallel to the axis of rotation, is hardened.

12. The device according to claim 10, wherein the positioning of a hydraulic valve (21) which controls the feed and discharge of cylinder chambers (3 and 5) of the hydraulic cylinder (7) causes feeding of fluid to the lower face (19) of hydraulic piston (1), by feeding of fluid via not less than one delivery line and bore (10) into the space between the upper face (18) of intensifier piston (2) and lower face (19) of hydraulic piston (1) and, thus, movement of the hydraulic piston from its "no product contact" starting position into its "product contact" pre-pressurizing position, a valve (21) subsequently being moved in such a way that all paths to bores (10 and 11) assigned to the hydraulic cylinder (7) of hydraulic piston (1) are closed and by subsequent setting of the intensifier valve (22), which controls the feed and discharge of cylinder chambers (4 and 6) of the intensifier piston (2), feeding of fluid to the lower face (20) of intensifier piston (2) occurs, by feeding of fluid via not less than one delivery line and bore (12) in the cylinder wall into a cylinder chamber (4) below the lower face (20) of intensifier piston (2), and therefore the intensifier piston (2) to be moved to its "pressed product" end position and this "pressed product" position to be retained for any period of time required, the intensifier valve (22) then being opened and the fluid in the cylinder chamber (4) below the lower face (20) of intensifier piston (2) being depressurized, and the hydraulic valve (21) then being positioned in such a way that fluid is fed via not less than one delivery line and bore (11) to an upper space (5) of the hydraulic cylinder (7) of hydraulic piston (1) and the pressure acting on the essentially annular and essentially parallel surface area of the circumferential reinforcement located opposite the lower face (19) of hydraulic cylinder (1) in such a way that hydraulic piston 1 moves into its "no product contact" starting position, the fluid enclosed in space (3) below hydraulic piston 1 acting on the upper face (18) of intensifier piston (2) and moving this, too, into its starting position.

13. The device according to claim 10, wherein a readily volatile fluid taken from the group formed by ethanol, methanol, isopropanol and similar substances or mixtures thereof is used as the fluid in the chamber (3 and 5) formed by hydraulic cylinder (7) and its hydraulic piston 1.

14. The device according to claim 10, wherein a readily volatile fluid taken from the group formed by ethanol, methanol, water, isopropanol and similar substances or mixtures thereof is used as the fluid in chambers (4 and 6) formed by intensifier cylinder (8) and its intensifier piston (2).

15. The device according to claim 10, wherein a working pressure of >180 bar is regularly achieved on the upper face (17) of hydraulic piston (1).

16. The device according to claim 10, wherein a gas consisting essentially of $CO_2$, oxygen, nitrogen, a noble gas or mixtures thereof is used as the fluid in the spaces formed by the hydraulic cylinder and the hydraulic piston.

17. The device according to claim 10, wherein a gas consisting essentially of $CO_2$, oxygen, nitrogen, a noble gas or mixtures thereof is used as the fluid in the spaces formed by the intensifier cylinder and the intensifier piston.

* * * * *